US005083413A

United States Patent [19]

Bennett

[11] Patent Number: 5,083,413

[45] Date of Patent: Jan. 28, 1992

[54] METHOD OF MAKING PLASTIC FILM BAG WITH A MULTI-LAYERED BIGHT THROUGH WHICH A HANGER EXTENDS

[75] Inventor: Ronald Bennett, Bay Shore, N.Y.

[73] Assignee: Ultra Creative Corp., Brooklyn, N.Y.

[21] Appl. No.: 647,538

[22] Filed: Jan. 29, 1991

Related U.S. Application Data

[62] Division of Ser. No. 373,154, Jun. 27, 1989, Pat. No. 5,009,515.

[51] Int. Cl.[5] ..... B65B 61/14

[52] U.S. Cl. ..... 53/413; 53/134.1; 493/226

[58] Field of Search ..... 53/413, 134.1, 410; 493/226, 926

[56] References Cited

U.S. PATENT DOCUMENTS

| | | | |
|---|---|---|---|
| 3,672,562 | 6/1972 | Bosse | 229/54 C |
| 3,693,867 | 9/1977 | Schwarzkopf | 229/54 R |
| 3,720,036 | 3/1973 | Armstrong | 53/413 |
| 3,765,597 | 10/1973 | Brieske | 229/62 |
| 3,782,622 | 1/1974 | Montgomery | 229/54 R |
| 4,084,689 | 4/1978 | Yamagata | 206/280 |
| 4,362,526 | 12/1982 | Wilson | 493/226 |
| 4,590,610 | 5/1986 | Rhyne | 383/23 |
| 4,704,100 | 11/1987 | Kaufman | 493/226 X |
| 4,834,553 | 5/1989 | Bennett | 383/23 |

FOREIGN PATENT DOCUMENTS

| | | | |
|---|---|---|---|
| 2552054 | 3/1985 | France | 493/226 |

*Primary Examiner*—James F. Coan
*Attorney, Agent, or Firm*—Ladas & Parry

[57] ABSTRACT

A thin plastic film bag design is provided according to which two plastic films are placed together in face-to-face relationship to form an enclosure. The film are sealed together at the lateral edge portions thereof but are open at the bottom extremity to allow stuffing contents into the defined enclosure. The sheets are so arranged at the upper extremity of the bag so as to define a supplemental enclosure which is delimited by at least two film layers. In the supplemental enclosure is entrapped the base of a hanger the hook portion of which is arranged on a throat extending through the multiple layers defining the supplemental enclosure. In one form the two layers are folded back on themselves at the upper extremity of the bag. In another form one of the films included in the associated bag is folded back on itself to form a U-shaped bight into which the other layer extends. In still another form one of the layers is folded back on itself and is then reversed to form a U-shaped bight into which the other plastic film extends. A seam is generally provided constituted by thermal welding which seals off the supplemental enclosure.

10 Claims, 2 Drawing Sheets

METHOD OF MAKING PLASTIC FILM BAG WITH A MULTI-LAYERED BIGHT THROUGH WHICH A HANGER EXTENDS

This is a continuation of copending application Ser. No. 07/373,154 filed on June 27, 1989, now U.S. Pat. No. 5,009,515.

FIELD OF INVENTION

This invention relates to plastic film bags and to methods appertaining thereto.

BACKGROUND

Packaged articles are frequently merchandised by inserting such articles into a transparent plastic film bag which is hung from a support by means of a handle or hanger or the like. Many of these bags are the subject of previously issued patents including by way of example U.S. Pat. Nos. 3,429,498 (J. Dorfman) and 4,590,610 (F. Rhyne).

In U.S. Pat. No. 3,429,498 is disclosed a plastic film bag with a carrying handle. This carrying handle has a portion entrapped within a bag enclosure which is defined by a bight which is of a single layer of film material. This single film layer is susceptible of being weaken by repeated applications of force to the handle and it will be found that, in manipulating the bag construction for purposes of packaging, display, or carrying or the like, the handle will tear loose thereby impairing the utility of the package.

In U.S. Pat. No. 4,590,610 is set forth a hanging product display package employing a rigid plastic hanger for supporting the bag on a rod or similar display structure. The base of the hanger is entrapped in a bight which is defined by a single layer of plastic film and repeated application of force to the hanger or package will lead to a tearing loose of the hanger and a consequent impairment of the utility of the same much as has been referred to above relative to the structure provided by J. Dorfman.

SUMMARY OF INVENTION

It is an object of the invention to provide an improved display package incorporating a hanger which is entrapped in a bight which is formed of a multi-layer arrangement of plastic films thereby to strengthen the anchoring structure with which the hanger is retained.

It is a further object of the invention to provide structures which are improvements of those shown in U.S. Pat. Nos. 3,429,498 and 4,590,610 and other such patents.

It is still another object of the invention to provide improved methods relating to the preparation of plastic film bags and the like which enable the above and other objects to be obtained while allowing mass production techniques at relatively low costs.

Still another object of the invention is to provide for improved packages allowing for the introduction of merchandise into the same via the lowermost extremities thereof.

In achieving the above and other objects of the invention there is provided in accordance therewith a bag construction comprising facing first and second sheets of plastic film having first and second extremities, at least one of these sheets constituting, at the first extremity of the bag, a multi-layered U-shaped bight, there being furthermore provided a hanger generally located within this bight but including a portion extending through and outwardly of the same. The second extremity is preferably the lower extremity and is open to permit access between the sheets. The lateral edge portions of the edge sheets are connected to each other such as by a thermal sea.

In accordance with one embodiment of the invention one of the aforesaid sheets is employed to constitute the multi-layered bight. According to another embodiment both of the sheets used to form the bag construction constituting the multi-layered bight.

In accordance with a specific embodiment of the invention one of the sheets is folded around the other of the sheets in continuation of the first U-shaped bight to form a second U-shaped bight. The other of the sheets extends into and terminates in the second bight.

According to another embodiment of the invention one of the sheets is folded back on itself twice to form the first said bight and a second bight. The other of the sheets extends into and terminates in the first said bight.

According to another aspect of the invention the first and second sheets are folded together at the first extremity to constitute the initial bight mentioned hereinabove.

In all of the preferred embodiments a seal closes off the initial U-shaped bight with the hanger entrapped therein. According to another aspect the aforesaid seal further connects the first and second sheets externally of the initial bight mentioned hereinabove.

As has been brought to attention the invention also is directed to a method. This method may generally comprise placing first and second sheets of plastic in face-to-face relation to form a bag with upper and lower extremities. At least one of the sheets is then folded to form a multi-layered U-shaped bight at the upper extremity. A hanger is inserted into the U-shaped bight with a portion of the hanger being extended through the bight.

As maybe understood from the general description advanced hereinabove the first and second sheets may be folded together through the U-shaped bight. Alternatively the first sheet may be folded once to form a first bight and is then folded back on itself twice to form a second and third bight. The first and third bights constitute the multi-layered bight into which the second hanger is inserted. In addition the upper extremity of the second sheet may be inserted into the multi-layered U-shaped bight. The multi-layered U-shaped bight may be sealed off by thermo sealing or the like. The method may further comprise cutting off the second bight.

According to another embodiment of the invention the first sheet may be folded to form a first bight and folded back along itself to form a second bight. The second sheet is folded in correspondence with the first bight to form said multi-layered bight and to terminate in the second bight. In this embodiment the second bight may also be severed and removed as scrap. The multi-layered bight may be sealed off with the hanger entrapped therein.

The above and other objects, features, and advantages of the invention will be found in the detailed description which follows hereinbelow as illustrated in the accompanying drawing.

BRIEF DESCRIPTION OF DRAWINGS

In the drawing:

FIG. 1(*b*) is an enlarged cross-sectional view as would appear along line I(b)—I(b) with the bight sealed off;

FIG. 2(*b*) is a cross-sectional view as would appear along line II(b)—II(b) with the bight sealed off;

FIG. 3(*b*) is a cross-sectional view as would appear along line III(b)—III(b) with the bight sealed off.

DETAILED DESCRIPTION

Figure 1A:
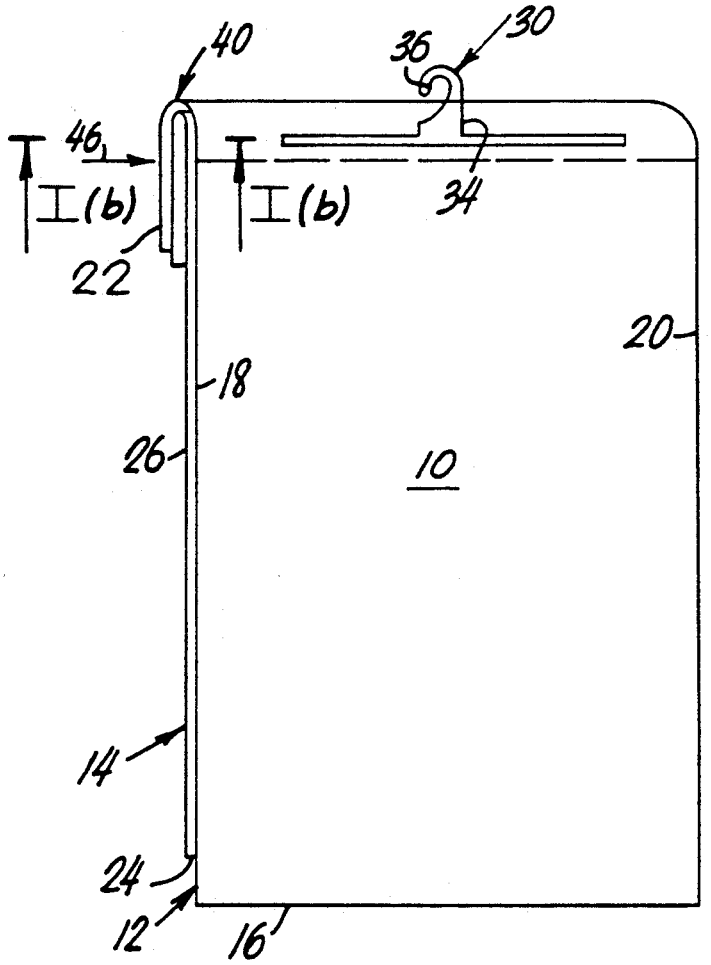
FIG. 1(*a*) is a diagrammatic perspective view illustrating a first embodiment of the invention.
Figure 1B:
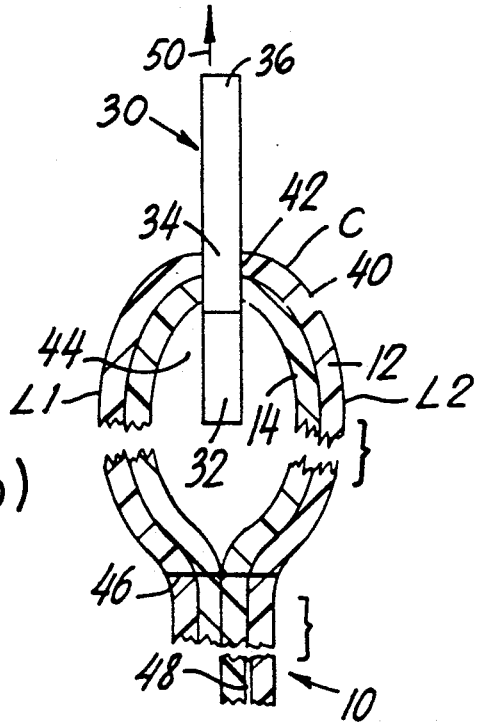

Referring next to the drawings, there are shown therein plastic bags fabricated of thin plastic films in the order, for example, of 0.002–0.005 inches. The thickness of film does not form a limitation of the invention except that in accordance with the invention the use of multiple layers of a film of given thickness will multiply the strength of the films for performing the function of entrapping the base portion of a hanger and in supporting the contents of the associated bag for purposes of display or transportation or the like. The plastic may for example be of polyethylene but other plastics or like materials may also be employed. Referring first to FIGS. 1(i a) and 1(*b*) it is seen that the bag 10 illustrated consists of sheets of film 12 and 14. Film 12 has a bottom extremity 16 and lateral extremities 18 and 20 and an upper extremity indicated generally at 22. Film 14 has a bottom extremity 24 and an illustrated lateral edge portion 26 as well as a parallel edge portion spaced therefrom but not appearing in the drawing.

Incorporated into the upper extremity bag 10 is a hanger generally indicated at 30. It includes a base 32, a throat 34 and a hook shaped portion 36. The hanger 30 is preferably fabricated of a single rigid piece of plastic such as for example polypropelene or the like. The material from which the hanger is made does not form a limitation of the scope of the invention.

At the upper extremity of the bag, it will be noted, the sheets 12 and 14 are jointly bent through a U-shaped bight indicated at 40. The sheet 12 maintains an outer position relative to the film 14 throughout the bight. These films are at apex of the bight provided with an opening 42 through which extends the throat 34 and hook shaped portion 36 of the hanger 30. The base of the hanger indicated at 32 is entrapped within the bight and resides in a supplemental enclosure 44 formed by the bight and further defined by a seam 46 which may be a conventional thermal seal which passes through the film 12, then through two face-to-face layers formed by the film 14 and then through the film 12 for a second time. The main enclosure of the bag 10 is formed as indicated at 48 between the film 12 and 14 which are placed in face-to-face relationship as has been indicated hereinabove.

Whereas in the usual bag of this nature the bight is formed of a single layer of plastic which is readily torn by forces applied for example in the direction illustrated by arrow 50, the bight in the illustrated embodiment of the invention is a bight which is formed of multiple layers of plastic which multiply the strength with which such tearing is resisted. This provides a significant advantage in respect of mounting such bags for display and then transporting such bags as will now be readily apparent.

Figure 2A:
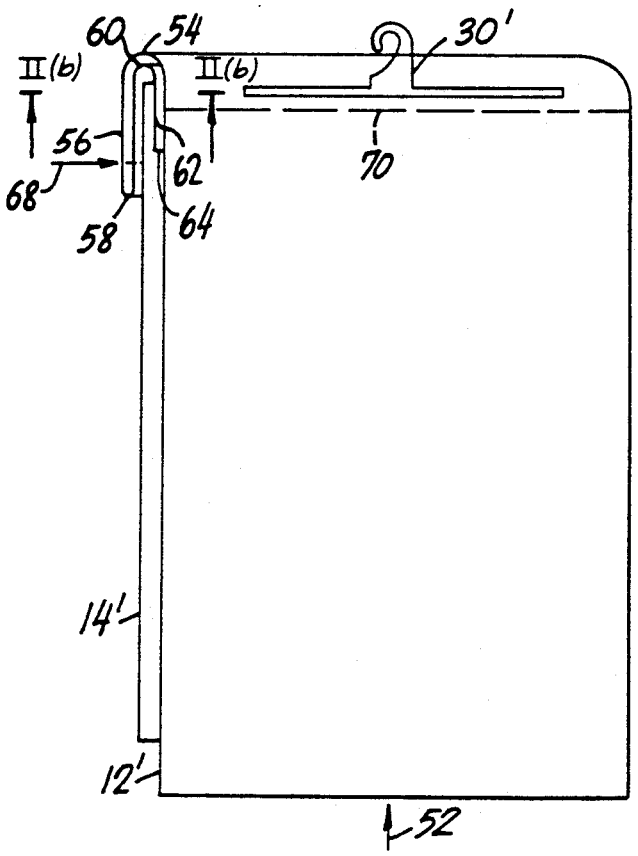
FIG. 2(*a*) is a diagrammatic perspective view of a plastic film bag arrangement illustrating a second embodiment.
Figure 2B:
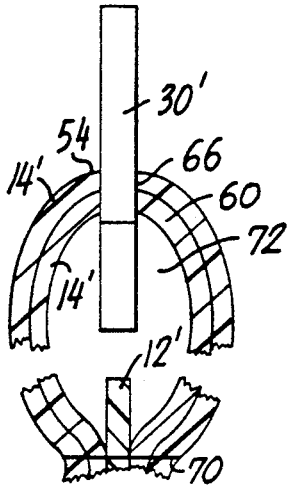

A second embodiment of the invention is illustrated in FIGS. 2(*a*) and 2(*b*). Therein also appears two layers 12' and 14' of the illustrated bag. Incidentally it will be noted that the lower extremity of the bag is initially maintained in open condition. This enables a loading of merchandise or other such items through the bottom of the bag as illustrated for example by arrow 52. This bottom loading is also possible in the embodiment of FIGS. 1(*a*) and 1(*b*) as well as in the embodiment of FIGS. 3(*a*) and 3(*b*).

In the embodiment of the invention illustrated in FIGS. 2(*a*) and 2(*b*) the layer 12' is folded into a bight 54 and then extends into a length 56 to a second bight 58 whereat the layer 12' is folded back on itself and thence through a third bight 60 and thence through a length 62 to terminate at edge 64. The film 14' extends upwardly to be accommodated in the third bight 60 with the first bight 54 and the third bight 60 providing a multi-layered U-shaped bight wherein resides the hanger 30' with the appropriate portion extending outwardly through opening 66 provided in the multi-layered bight as has been described above relative to the first embodiment. The embodiment of the invention illustrated in FIGS. 2(*a*) and 2(*b*) involves all of the advantages which inure to the benefit of the embodiment illustrated in FIGS. 1(*a*) and 1(*b*). The excess of material may be trimmed as indicated at line 68. The seal which is formed may be applied as indicated at 70. The multiple layers of film which form the supplemental enclosure 72 serve to strengthen the U-shaped bight formed by bights 54 and 60 and thereby contribute to preserving the integrity of the package as well as to the resistance against forces which may be applied to the bag and/or hanger.

Figure 3A:
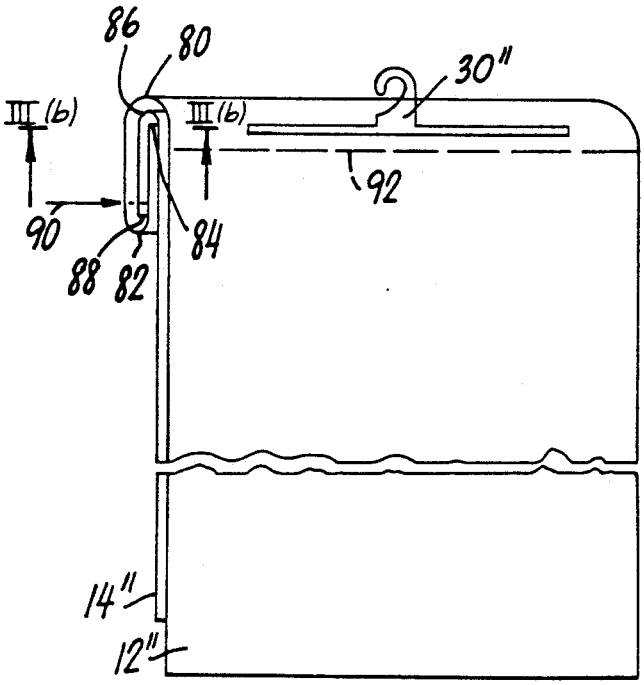
FIG. 3(*a*) is a diagrammatical perspective view of a plastic film bag provided with a hanger illustrating a third embodiment of the invention.
Figure 3B:
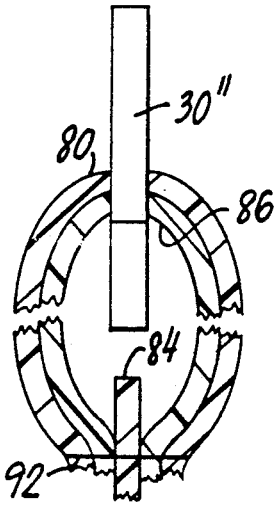

A third embodiment of the invention shown in FIGS. 3(*a*) and 3(*b*) involves sheets or films 12'' and 14'' as well as a hanger 30''. In this embodiment of the invention, film 12'' is folded back on itself at 80 to form a U-shaped bight and is then folded back on itself at 82 to form a second U-shaped bight. The film terminates at edge 84.

The film 14'' is folded back on itself at 86 to form a U-shaped bight in correspondence with the U-shaped 80. The film 14' terminates at 88. It will be noted that the film 14'' terminates in the bight 82. The trim line for this excess material is indicated at 90. The seal is indicated at line 92. In this embodiment of the invention as well as in the other embodiments of the invention the base of the hanger is entrapped in the supplemental enclosure formed by the seal (e.g., line 92) which closes off the supplemental enclosure.

The method of the invention thus includes placing first and second sheets of plastic film in face-to-face relationship as has been illustrated hereinabove with respect to the various figures of the drawings. This forms a bag with upper and lower extremities. At least one of the sheets is folded at the upper extremity to form a multi-layered U-shaped bight. A hanger is inserted into the U-shaped bight with a portion of the hanger being extended therethrough. The first and second sheets may be folded together in juxtaposition through the U-shaped bight to form the same.

In accordance with one embodiment of the invention the first sheet may be folded once to form a first bight and is then folded back on itself twice to form a second and third bights. In this case the first and third bight constitute the multi-layered bight into which the hanger is inserted.

The upper extremity of the second sheet may be inserted into the multi-layered U-shaped bight according to another embodiment of the invention. The multi-layered U-shaped bight is sealed off to form a supplemental enclosure in which the base of the hanger is entrapped. The excess material may be trimmed off as has been noted hereinabove.

According to another embodiment of the invention and the method provided therewith the first sheet may be folded to form a first bight and folded back along itself to form second bight with the second sheet being folded in correspondence with the first bight to form the multi-layered bight and to terminate in the second bight.

With reference to FIG. 1(*b*), it is seen that the bight which is formed has a curved section C with legs L1 and L2 connected thereto. Sheets 12 and 14 form this multi-layered bight with sheet 14 extending into and closely adjacent curved section C and forming part of the same. This is also true of sheet 14" in FIG. 3(*a*) whereas sheet 14' extends into and closely adjacent the uppermost multi-layered bight in FIG. 2(*a*) with the difference that sheet 14' terminates adjacent the associated curved section of the bight.

There will now be obvious to those skilled in the art many modifications and variations of the structures and methods set forth hereinabove. These modifications and variations will not depart from the scope of the invention if defined by the following claims.

What is claimed is:

1. A method comprising placing first and second sheets of plastic film in face-to-face relation to form a bag with upper and lower extremities, folding at least one of said sheets to form a multi-layered U-shaped bight with juxtaposed multiple layers at said upper extremity, inserting a hanger into said U-shaped bight with a portion of the hanger being extended through said multiple layers, sealing the lateral extremities of the sheets together, and sealing off the multi-layered U-shaped bight.

2. A method as claimed in claim 1 wherein the first and second sheets are folded together in juxtaposition through said U-shaped bight to form said multi-layered U-shaped bight.

3. A method as claimed in claim 1 comprising loading the bag from the bottom extremity which is thereafter sealed.

4. A method comprising placing first and second sheets of plastic film in face-to-face relation to form a bag with upper and lower extremities, folding at least one of said sheets to form a multi-layered U-shaped bight at said upper extremity, and inserting a hanger into said U-shaped bight with a portion of the hanger being extended therethrough, the first sheet being folded once to form a first bight and being then folded back on itself twice to form a second and a third bight, said first and third bights constituting said multi-layered bight into which said hanger is inserted.

5. A method as claimed in claim 4 comprising inserting the upper extremity of the second sheet into the multi-layered U-shaped bight.

6. A method as claimed in claim 4 comprising sealing off the multi-layered bight.

7. A method as claimed in claim 6 comprising cutting off the second bight.

8. A method comprising placing first and second sheets of plastic film in face-to-face relation to form a bag with upper and lower extremities, folding at least one of said sheets to form a multi-layered U-shaped bight at said upper extremity, and inserting a hanger into said U-shaped bight with a portion of the hanger being extended therethrough, the first sheet being folded to form a first bight and being folded back along itself to form a second bight, the second sheet being folded in correspondence with the first bight to form said multi-layered bight and to terminate in the second bight.

9. A method as claimed in claim 8 comprising cutting off the second bight.

10. A method as claimed in claim 9 comprising sealing off said multi-layered bight with the hanger entrapped therein.

* * * * *